US010508845B2

(12) United States Patent
Nagae et al.

(10) Patent No.: US 10,508,845 B2
(45) Date of Patent: Dec. 17, 2019

(54) REFRIGERATION CYCLE SYSTEM

(71) Applicant: Mitsubishi Electric Corporation, Tokyo (JP)

(72) Inventors: Takao Nagae, Tokyo (JP); Ryo Oya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 136 days.

(21) Appl. No.: 15/554,021

(22) PCT Filed: Jun. 2, 2015

(86) PCT No.: PCT/JP2015/065921
§ 371 (c)(1),
(2) Date: Aug. 28, 2017

(87) PCT Pub. No.: WO2016/194143
PCT Pub. Date: Dec. 8, 2016

(65) Prior Publication Data
US 2018/0031287 A1 Feb. 1, 2018

(51) Int. Cl.
*F25B 41/04* (2006.01)
*F25B 5/02* (2006.01)
*F25B 6/02* (2006.01)

(52) U.S. Cl.
CPC ..... *F25B 41/043* (2013.01); *F25B 5/02* (2013.01); *F25B 6/02* (2013.01); *F25B 41/04* (2013.01);
(Continued)

(58) Field of Classification Search
CPC ..... F25B 2400/06; F25B 2400/075; F25B 2600/2501; F25B 2600/2517;
(Continued)

(56) References Cited

U.S. PATENT DOCUMENTS 5,388,420 A 2/1995 Yoshida et al.
6,298,683 B1 * 10/2001 Kondo ..... F25B 7/00 62/335
6,357,242 B1 * 3/2002 Farley ..... B60H 1/3208 62/133

FOREIGN PATENT DOCUMENTS

JP H06-300381 A 10/1994
JP H07-174422 A 7/1995
(Continued)

OTHER PUBLICATIONS

The American Society of Mechanical Engineers, Graphical Symbols for Pipe Fittings, Valves, and Piping, 1953, p. 8 (Year: 1953).*
(Continued)

*Primary Examiner* — Edward F Landrum
*Assistant Examiner* — Chang H. Park
(74) *Attorney, Agent, or Firm* — Posz Law Group, PLC

(57) ABSTRACT

A refrigeration cycle system includes: a first refrigeration cycle apparatus which is connected to a first compressor, a first condenser, a first pressure reduction device, and a first evaporator and through which the refrigerant circulates; a second refrigeration cycle apparatus which is connected to a second compressor, a second condenser, and a second pressure reduction device, and a second evaporator; a first bypass passage connecting a portion between the first evaporator and the first compressor to a portion between the second evaporator and the second compressor; and a second bypass passage connecting a portion between the first condenser and the first pressure reduction device to a portion between the second condenser and the second pressure reduction device.

6 Claims, 11 Drawing Sheets

(52) U.S. Cl.
CPC ..... *F25B 2400/06* (2013.01); *F25B 2400/075* (2013.01)

(58) Field of Classification Search
CPC ..... F25B 2700/193; F25B 2700/2116; F25B 41/04; F25B 41/043; F25B 5/02; F25B 6/02
USPC ..... 62/228.196, 228.3, 217, 196.1
See application file for complete search history.

(56) References Cited

FOREIGN PATENT DOCUMENTS

| | | | |
|---|---|---|---|
| JP | H07-174423 | A | 7/1995 |
| JP | 2000-193330 | A | 7/2000 |
| JP | 2005-153683 | A | 6/2005 |
| JP | 2007-127304 | A | 5/2007 |
| JP | 2014-215008 | A | 11/2014 |
| JP | 2014215008 | A * | 11/2014 |

OTHER PUBLICATIONS

Chinese office action corresponding to the Chinese Patent Application No. 201610258302.8 dated Apr. 3, 2018 with English translation.
International Search Report of the International Searching Authority dated Aug. 4, 2015 for the corresponding international application No. PCT/JP2015/065921 (and English translation).
Extended European Search Report dated Feb. 27, 2017 for the corresponding European application No. 15 87 6397.9.
Office Action dated Oct. 17, 2018 issued in corresponding CN patent application No. 201610258302.8 (and English translation).

* cited by examiner

FIG. 2

| | |
|---|---|
| FIRST VALVE 312 | CLOSED |
| SECOND VALVE 322 | CLOSED |
| THIRD VALVE 120 | OPEN |
| FOURTH VALVE 220 | OPEN |
| FIFTH VALVE 114 | OPEN |
| SIXTH VALVE 214 | OPEN |

FIG. 4

| | |
|---|---|
| FIRST VALVE 312 | OPEN |
| SECOND VALVE 322 | OPEN |
| THIRD VALVE 120 | OPEN |
| FOURTH VALVE 220 | OPEN |
| FIFTH VALVE 114 | OPEN |
| SIXTH VALVE 214 | OPEN |

| | |
|---|---|
| FIRST VALVE 312 | OPEN |
| SECOND VALVE 322 | OPEN |
| THIRD VALVE 120 | OPEN |
| FOURTH VALVE 220 | OPEN |
| FIFTH VALVE 114 | OPEN |
| SIXTH VALVE 214 | CLOSED |

FIG. 9

| | |
|---|---|
| FIRST VALVE 312 | OPEN |
| SECOND VALVE 322 | OPEN |
| THIRD VALVE 120 | CLOSED |
| FOURTH VALVE 220 | OPEN |
| FIFTH VALVE 114 | OPEN |
| SIXTH VALVE 214 | OPEN |

| | |
|---|---|
| FIRST VALVE 312 | OPEN |
| SECOND VALVE 322 | OPEN |
| THIRD VALVE 120 | CLOSED |
| FOURTH VALVE 220 | OPEN |
| FIFTH VALVE 114 | OPEN |
| SIXTH VALVE 214 | CLOSED |

REFRIGERATION CYCLE SYSTEM

CROSS REFERENCE TO RELATED APPLICATION

This application is a U.S. national stage application of PCT/JP2015/065921 filed on Jun. 2, 2015, the contents of which are incorporated herein by reference.

TECHNICAL FIELD

The present invention relates to a refrigeration cycle system including a first refrigeration cycle apparatus and a second refrigeration cycle apparatus.

BACKGROUND ART

In a conventional air-conditioning apparatus, two outdoor units are connected in parallel to inter-unit pipes including a gas pipe and a liquid pipe and two indoor units are connected in parallel (see Patent Literature 1). In the conventional air-conditioning apparatus described in Patent Literature 1, in a case where one of the outdoor units malfunctions or is broken, this outdoor unit is not operated and the other outdoor unit is used for an air conditioning operation.

CITATION LIST

Patent Literature

Patent Literature 1: Japanese Unexamined Patent Application Publication No. 2007-127304

SUMMARY OF INVENTION

Technical Problem

In the conventional refrigeration cycle system described in Patent Literature 1, the two outdoor units are connected in parallel to the inter-unit pipes and the two indoor units are connected in parallel. Thus, the system has low versatility.

The present invention has been made in view of the foregoing problems, and has an object of providing a refrigeration cycle system with enhanced versatility.

Solution to Problem

A refrigeration cycle system according to the present invention includes: a first refrigeration cycle apparatus which is connected to a first compressor, a first condenser, a first pressure reduction device, and a first evaporator, and through which the refrigerant circulates; a second refrigeration cycle apparatus which is connected to a second compressor, a second condenser, a second pressure reduction device, and a second evaporator, and through which the refrigerant circulates; a first bypass passage connecting a portion between the first evaporator and the first compressor to a portion between the second evaporator and the second compressor; and a second bypass passage connecting a portion between the first condenser and the first pressure reduction device to a portion between the second condenser and the second pressure reduction device.

Advantageous Effects of Invention

According to the present invention, a refrigeration cycle system with enhanced versatility can be obtained.

BRIEF DESCRIPTION OF DRAWINGS

FIG. 2 illustrates an example of open/close states of valves in a normal operation mode of the refrigeration cycle system illustrated in FIG. 1.

FIG. 4 shows open/close states of valves when a condensing temperature is abnormally high as shown in FIG. 3.

FIG. 9 shows open/close states of valves when the high-pressure is abnormally high as shown in FIG. 8.

DESCRIPTION OF EMBODIMENTS

Figure 1:
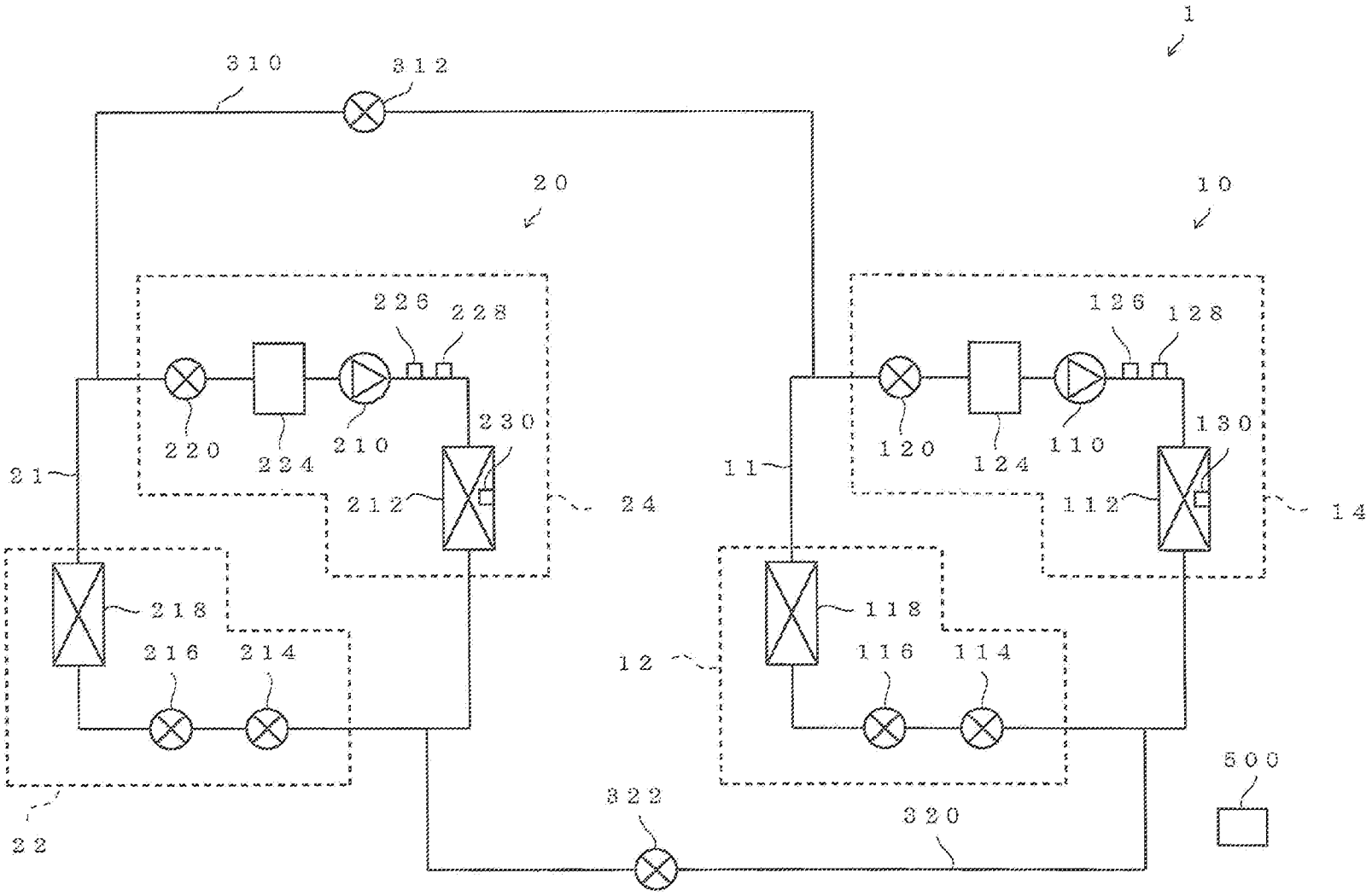
FIG. 1 schematically illustrates an example configuration of a refrigeration cycle system according to Embodiment 1 of the present invention.

Embodiments of the present invention will be described hereinafter with reference to the drawings. In the drawings, like or corresponding elements are denoted by the same reference numerals, and description thereof is not repeated or simplified as necessary. The dimensions, locations, and arrangement, for example, of components illustrated in the drawings can be appropriately modified within the scope of the invention.

Embodiment 1

Refrigeration Cycle Apparatus

FIG. 1 schematically illustrates an example configuration of a refrigeration cycle system according to Embodiment 1 of the present invention. The refrigeration cycle system 1 illustrated in FIG. 1 performs air-conditioning in a structure such as a building or a house, for example. The refrigeration cycle system 1 includes a first refrigeration cycle apparatus 10, a second refrigeration cycle apparatus 20, and a first bypass passage 310 and a second bypass passage 320 connecting the first refrigeration cycle apparatus 10 and the second refrigeration cycle apparatus 20 to each other. The refrigeration cycle system 1 includes a controller 500 for controlling the entire refrigeration cycle system 1. The controller 500 may be included in the first refrigeration cycle apparatus 10 or the second refrigeration cycle apparatus 20, or may be a combination of a controller (not shown) of the first refrigeration cycle apparatus 10 and a controller (not shown) of the second refrigeration cycle apparatus 20.

First Refrigeration Cycle Apparatus

The first refrigeration cycle apparatus 10 includes a first refrigerant circuit 11 through which the refrigerant circulates and which is constituted by connecting a first heat source side unit 14 and a first load side unit 12 to each other by pipes. The first refrigerant circuit 11 is constituted by connecting at least a first compressor 110, a first condenser 112, a fifth valve 114, a first pressure reduction device 116, a first evaporator 118, a third valve 120, and a first accumulator 124 by pipes. The first refrigerant circuit 11 may further include, for example, an oil separator for protecting the first compressor 110 and a heat exchanger for adjusting the degree of subcooling.

First Heat Source Side Unit

The first heat source side unit 14 is disposed outdoors outside a room, for example, and houses the first compressor 110, the first condenser 112, the third valve 120, and the first accumulator 124 therein. The first compressor 110 is an inverter compressor controlled by an inverter and has a capacity (the amount refrigerant delivered in a unit time) that is changeable by arbitrarily changing the operating frequency. The first compressor 110 may be a constant-speed compressor that operates at a constant operating frequency.

The first condenser 112 heat exchanges between refrigerant flowing in the first condenser 112 and air to condense the refrigerant. For example, a fan (not shown) for guiding air to the first condenser 112 is disposed near the first condenser 112. The third valve 120 controls passage of refrigerant by opening and closing operations, and is constituted by, for example, a motor-operated valve having an adjustable opening degree. The first accumulator 124 is a container storing surplus refrigerant and is connected to a suction side of the first compressor 110.

The first heat source side unit 14 includes a first pressure detection device 126, a first pipe temperature detection device 128, and a first condensing temperature detection device 130. The first pressure detection device 126 is disposed on, for example, a pipe connecting the first compressor 110 and the first condenser 112 to each other, and detects a pressure of refrigerant discharged from the first compressor 110. The first pipe temperature detection device 128 is disposed on, for example, a pipe connecting the first compressor 110 and the first condenser 112 to each other, and detects a temperature of refrigerant discharged from the first compressor 110. The first condensing temperature detection device 130 is disposed in, for example, the first condenser 112, and detects a condensing temperature of refrigerant. The condensing temperature of refrigerant can also be obtained by using the pressure value detected by the first pressure detection device 126. In the case of obtaining the condensing temperature of refrigerant by using the pressure value detected by the first pressure detection device 126, the first condensing temperature detection device 130 may be omitted.

First Load Side Unit

The first load side unit 12 is disposed indoors, that is, in a room, and houses the fifth valve 114, the first pressure reduction device 116, and the first evaporator 118 therein. The fifth valve 114 controls passage of refrigerant by opening and closing operations, and is constituted by, for example, a motor-operated valve having an adjustable opening degree. The first pressure reduction device 116 reduces a pressure of refrigerant passing through the first pressure reduction device 116, and is, for example, a motor-operated valve having an adjustable opening degree. However, the first pressure reduction device 116 may be constituted by, for example, a capillary tube. In the case where the first pressure reduction device 116 is a motor-operated valve having an adjustable opening degree, the fifth valve 114 can be omitted in some cases. In such cases, the first pressure reduction device 116 functions as the fifth valve 114. The first evaporator 118 heat exchanges between refrigerant flowing in the first evaporator 118 and air, for example, and evaporates the refrigerant. For example, a fan (not shown) for guiding air to the first evaporator 118 is disposed near the first evaporator 118.

Second Refrigeration Cycle Apparatus

Since the second refrigeration cycle apparatus 20 has substantially the same configuration as that of the first refrigeration cycle apparatus 10, and thus, description thereof is simplified for easy understanding of Embodiment 1. The second refrigeration cycle apparatus 20 includes a second refrigerant circuit 21, a second load side unit 22, a second heat source side unit 24, a second compressor 210, a second condenser 212, a sixth valve 214, a second pressure reduction device 216, a second evaporator 218, a fourth valve 220, a second accumulator 224, a second pressure detection device 226, a second pipe temperature detection device 228, and a second condensing temperature detection device 230 that are respectively correspond to the first refrigerant circuit 11, the first load side unit 12, the first heat source side unit 14, the first compressor 110, the first condenser 112, the fifth valve 114, the first pressure reduction device 116, the first evaporator 118, the third valve 120, the first accumulator 124, the first pressure detection device 126, the first pipe temperature detection device 128, and the first condensing temperature detection device 130 of the first refrigeration cycle apparatus 10. The first refrigeration cycle apparatus 10 and the second refrigeration cycle apparatus 20 may have the same refrigeration capacity, but may have different refrigeration capacities. That is, for example, the first compressor 110 and the second compressor 210 may have the same capacity, but may have different capacities. The first condenser 112 and the second condenser 212 may have the same degree of heat exchange capacity, but may have different degrees of heat exchange capacity. The first evaporator 118 and the second evaporator 218 may have the same heat exchange capacity, but may have different heat exchange capacities.

First Bypass Passage and Second Bypass Passage

The first bypass passage 310 and the second bypass passage 320 connect the first refrigeration cycle apparatus 10 and the second refrigeration cycle apparatus 20 to each other. The first bypass passage 310 is constituted by pipes connecting a portion between the first evaporator 118 of the first refrigeration cycle apparatus 10 and a suction side of the first compressor 110 to a portion between the second evaporator 218 of the second refrigeration cycle apparatus 20 and a suction side of the second compressor 210. In the example of Embodiment 1, the first bypass passage 310 connects a portion between the first evaporator 118 and the third valve 120 to a portion between the second evaporator 218 and the fourth valve 220. The second bypass passage 320 is constituted by pipes connecting a portion between the first condenser 112 of the first refrigeration cycle apparatus 10 and the first pressure reduction device 116 to a portion between the second condenser 212 of the second refrigeration cycle apparatus 20 and the second pressure reduction device 216. In the example of Embodiment 1, the second bypass passage 320 connects a portion between the first condenser 112 and the fifth valve 114 to a portion between the second condenser 212 and the sixth valve 214. In the example of Embodiment 1, the first bypass passage 310 and the second bypass passage 320 are connected to the pipe connecting the first heat source side unit 14 and the first load side unit 12 to each other and the pipe connecting the second heat source side unit 24 and the second load side unit 22 to each other, and thus, are easily connected to each other. A first valve 312 is disposed on the first bypass passage 310, and a second valve 322 is disposed on the second bypass passage 320. The first valve 312 and the second valve 322 control passage of refrigerant by opening and closing operations, and are constituted by, for example, motor-operated valves each having an adjustable opening degree.

Operation of Refrigeration Cycle System

Next, an operation mode of the refrigeration cycle system 1 illustrated in FIG. 1 will be described. The refrigeration cycle system 1 according to Embodiment 1 has a normal operation mode, a condensing temperature restricting operation mode, and an abnormally high pressure operation mode. The normal operation mode is performed in a normal state in which neither the first refrigeration cycle apparatus 10 nor the second refrigeration cycle apparatus 20 is in an abnormal state. The condensing temperature restricting operation mode is performed in an abnormal state in which the condensing temperature of the first refrigeration cycle apparatus 10 or the second refrigeration cycle apparatus 20 is abnormally high. The abnormally high pressure operation mode is performed when the discharge pressure of the first compressor 110 or the second compressor 210 is abnormally high. For example, in the example of Embodiment 1, the controller 500 performs a high-pressure abnormality determination on the high pressure using a detection result of the first pressure detection device 126 and a detection result of the second pressure detection device 226, performs a high-temperature abnormality determination on the condensing temperature using a detection result of the first condensing temperature detection device 130 and a detection result of the second condensing temperature detection device 230, and controls the first refrigeration cycle apparatus 10, the second refrigeration cycle apparatus 20, the first valve 312, and the second valve 322, thereby performing the normal operation mode, the condensing temperature restricting operation mode, or the abnormally high pressure operation mode. In the refrigeration cycle system 1 according to Embodiment 1, the abnormally high pressure operation mode has priority to the condensing temperature restricting operation mode. That is, in the case showing high-pressure abnormality on the high-pressure and high-temperature abnormality on the condensing temperature, the abnormally high pressure operation mode is performed.

Normal Operation Mode

FIG. 2 illustrates an example of open/close states of the valves in the normal operation mode of the refrigeration cycle system illustrated in FIG. 1. As shown in FIG. 2, in a case where the refrigeration cycle system 1 operates in the normal operation mode, the first valve 312 and the second valve 322 are closed, and the first refrigeration cycle apparatus 10 and the second refrigeration cycle apparatus 20 each operate independently. For example, in the first refrigeration cycle apparatus 10, the third valve 120 and the fourth valve 220 are open and the first compressor 110 operate so that refrigerant circulates in the first refrigerant circuit 11. For example, in the second refrigeration cycle apparatus 20, the fifth valve 114 and the sixth valve 214 are open and the second compressor 210 operates so that refrigerant circulates in the second refrigerant circuit 21. In a case where one of the first refrigeration cycle apparatus 10 and the second refrigeration cycle apparatus 20 operates, at least the valve disposed in the operating refrigeration cycle apparatus only needs to be open.

Thereafter, an operation of the first refrigeration cycle apparatus 10 in the normal operation mode of the refrigeration cycle system 1 will be described. Refrigerant compressed in the first compressor 110 flows into the first condenser 112. In the first condenser 112, the refrigerant exchanges heat with air and is condensed. The refrigerant condensed in the first condenser 112 passes through the fifth valve 114 and has the pressure thereof reduced in the first pressure reduction device 116. The refrigerant whose pressure has been reduced in the first pressure reduction device 116 exchanges heat with air in the first evaporator 118 and evaporates. The refrigerant evaporated in the first evaporator 118 passes through the third valve 120 and the first accumulator 124 and is sucked into the first compressor 110 and compressed again. An operation of the second refrigeration cycle apparatus 20 in the normal operation mode of the refrigeration cycle system 1 is similar to the operation of the first refrigeration cycle apparatus 10 described above, and thus, description thereof is not repeated.

Condensing Temperature Restricting Operation Mode

In the refrigeration cycle system 1 according to Embodiment 1, when the condensing temperature of the first refrigeration cycle apparatus 10 or the second refrigeration cycle apparatus 20 becomes abnormally high, the condensing temperature restricting operation mode described later is performed so that the first refrigeration cycle apparatus 10 or the second refrigeration cycle apparatus 20 having such an abnormally high condensing temperature is protected. This is because when the condensing temperature of the first refrigeration cycle apparatus 10 or the second refrigeration cycle apparatus 20 becomes abnormally high, the condenser and pipes in which high-temperature refrigerant flows might be deformed or damaged, for example. In a case where the outdoor-air temperature is high, for example, the condensing temperature of the first refrigeration cycle apparatus 10 or the second refrigeration cycle apparatus 20 becomes abnormally high. For example, if a condensing temperature t1 of the first refrigeration cycle apparatus 10 becomes higher than a determination temperature T1, the condensing temperature of the first refrigeration cycle apparatus 10 is determined to be abnormally high. If a condensing temperature t2 of the second refrigeration cycle apparatus 20 becomes higher than a determination temperature T2, for example, the condensing temperature of the second refrigeration cycle apparatus 20 is determined to be abnormally high. The determination temperature T1 and the determination temperature T2 are defined based on, for example, specifications of the first refrigeration cycle apparatus 10 and the second refrigeration cycle apparatus 20, and can be the same or different from each other. The following description is directed only to an operation when the condensing temperature t1 of the first refrigeration cycle apparatus 10 becomes abnormally high. An operation when the condensing temperature t2 of the second refrigeration cycle apparatus 20 becomes abnormally high is similar to an operation when the condensing temperature t1 of the first refrigeration cycle apparatus 10 becomes abnormally high, and thus, description thereof will be omitted.

Figure 3:
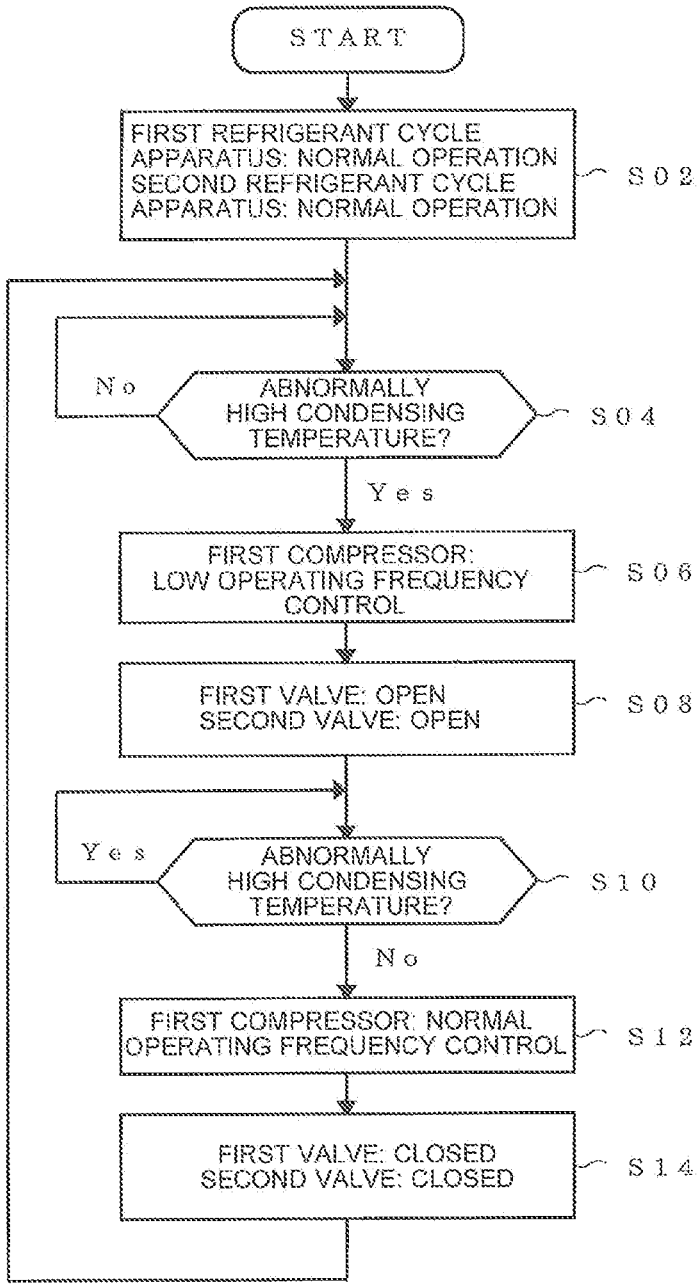
FIG. 3 shows an example operation of the refrigeration cycle system illustrated in FIG. 1 in a condensing temperature restricting operation mode.
Figure 5:
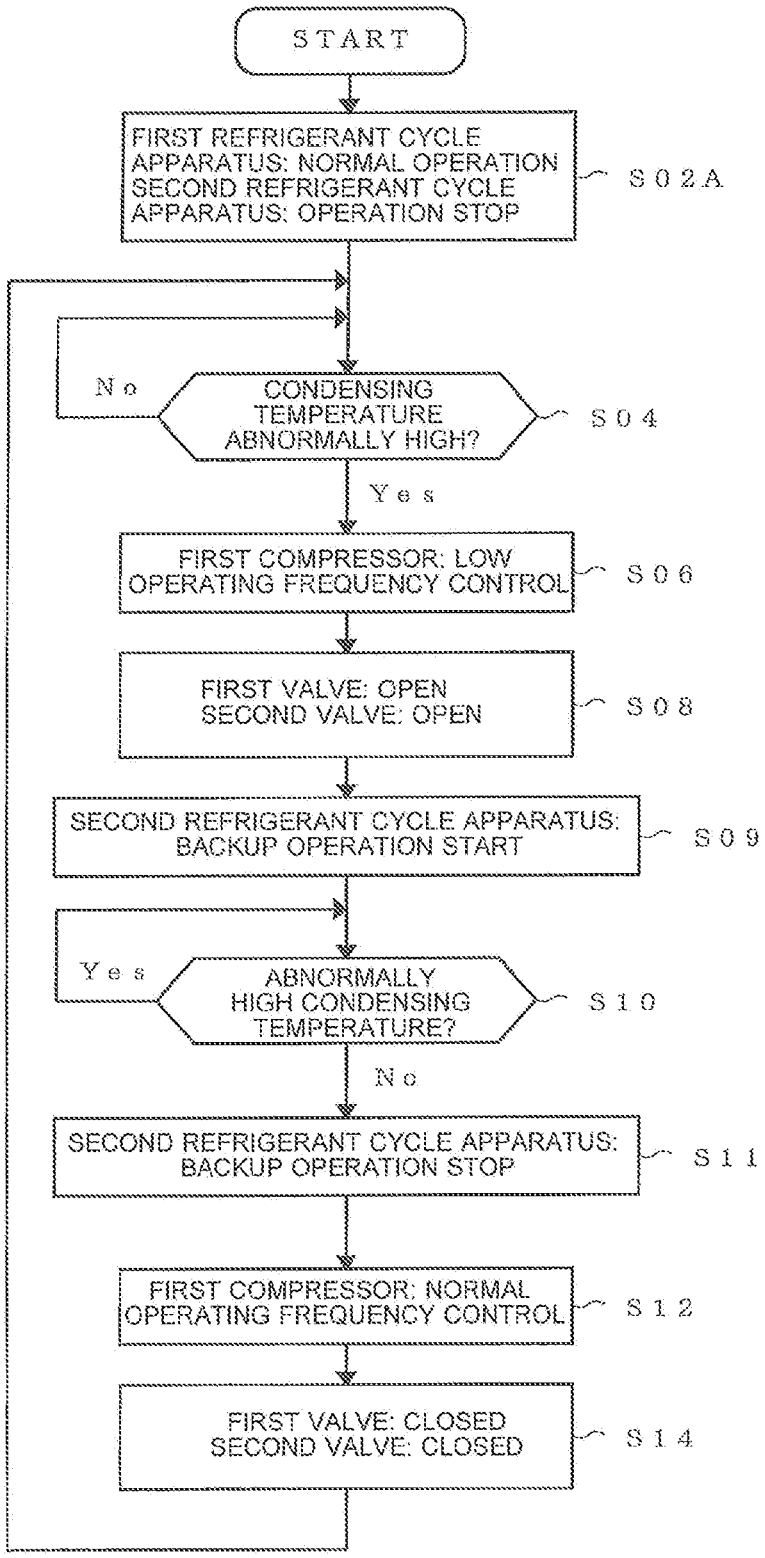
FIG. 5 shows another example operation of the refrigeration cycle system illustrated in FIG. 1 in the condensing temperature restricting operation mode.
Figures 6, 7:
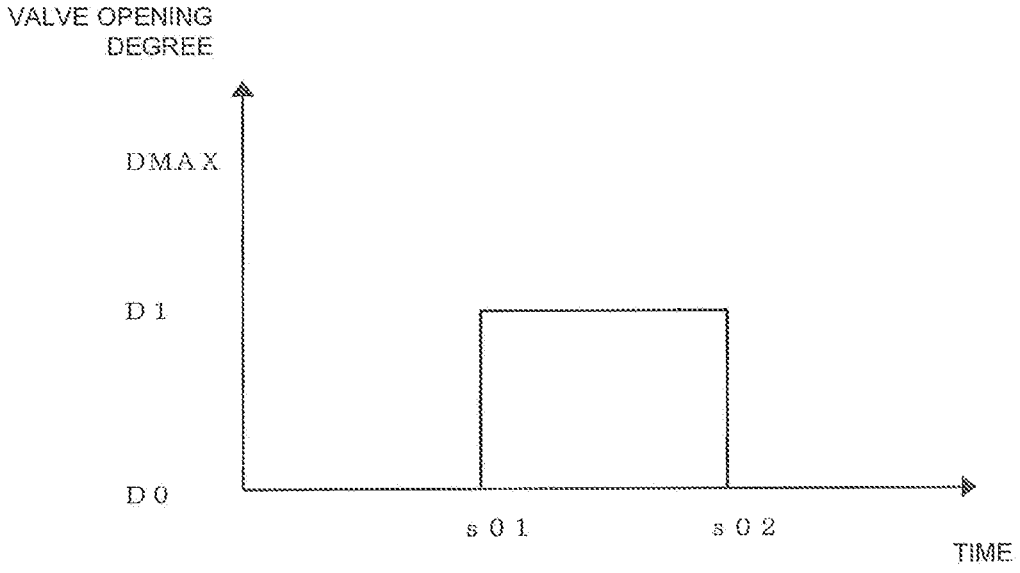
FIG. 6 shows open/close states of valves when the condensing temperature is abnormally high as shown in FIG. 5.
FIG. 7 shows example opening degrees of a first valve and a second valve in the condensing temperature restricting operation mode of the refrigeration cycle system illustrated in FIG. 1.

FIG. 3 shows an example operation of the refrigeration cycle system illustrated in FIG. 1 in the condensing temperature restricting operation mode. FIG. 4 shows open/close states of the valves when the condensing temperature is abnormally high as shown in FIG. 3. FIG. 5 shows another example operation of the refrigeration cycle system illustrated in FIG. 1 in the condensing temperature restricting operation mode. FIG. 6 shows open/close states of the valves when the condensing temperature is abnormally high as shown in FIG. 5. The example of the condensing temperature restricting operation mode of the refrigeration cycle system 1 described with reference to FIGS. 3 and 4 is an example in which the condensing temperature t1 of the first refrigeration cycle apparatus 10 becomes abnormally high while the first refrigeration cycle apparatus 10 and the second refrigeration cycle apparatus 20 are in normal operation. The example operation of the condensing temperature restricting operation mode of the refrigeration cycle system 1 illustrated in FIGS. 5 and 6 is an example in which the condensing temperature t1 of the first refrigeration cycle apparatus 10 becomes abnormally high while the first refrigeration cycle apparatus 10 is in normal operation and the second refrigeration cycle apparatus 20 is stopped.

First, an example of the condensing temperature restricting operation mode of the refrigeration cycle system 1 will be described with reference to FIGS. 3 and 4. At step S02 in FIG. 3, the first refrigeration cycle apparatus 10 and the second refrigeration cycle apparatus 20 illustrated in FIG. 1 are in normal operation. In the normal operation of the first refrigeration cycle apparatus 10 and the second refrigeration cycle apparatus 20 at step S02, the first valve 312 and the second valve 322 are closed, the third valve 120, the fourth valve 220, the fifth valve 114, and the sixth valve 214 are open, and the first refrigeration cycle apparatus 10 and the second refrigeration cycle apparatus 20 each operate independently.

At step S04 in FIG. 3, it is determined whether the condensing temperature t1 of the first refrigeration cycle apparatus 10 is abnormally high. If it is determined that the condensing temperature t1 of the first refrigeration cycle apparatus 10 is not abnormally high, the normal operations of the first refrigeration cycle apparatus 10 and the second refrigeration cycle apparatus 20 continue.

At step S04, if it is determined that the condensing temperature t1 of the first refrigeration cycle apparatus 10 is abnormally high, the process proceeds to step S06, where a low operating frequency control of the first compressor 110 is performed. The low operating frequency control of the first compressor 110 is a control in which the first compressor 110 operates at an operating frequency lower than an operating frequency in a normal operation frequency control in which the first compressor 110 is in normal operation. The reduction of the operating frequency of the first compressor 110 can reduce the condensing temperature t1 of the first refrigeration cycle apparatus 10. As the operating frequency of the first compressor 110 is reduced, the airflow rate of a fan (not shown) for guiding air to the first evaporator 118 can be increased.

Next, at step S08, the first valve 312 and the second valve 322 are made open, as indicated in FIG. 4. As illustrated in FIG. 1, when the first valve 312 and the second valve 322 are open, part of refrigerant flowed out of the second heat source side unit 24 of the second refrigeration cycle apparatus 20 is merged with refrigerant flowed out of the first heat source side unit 14 of the first refrigeration cycle apparatus 10, and is supplied to the first load side unit 12 of the first refrigeration cycle apparatus 10. That is, part of refrigerant compressed in the second compressor 210 and condensed in the second condenser 212 passes through the second bypass passage 320, is merged with refrigerant compressed in the first compressor 110 and condensed in the first condenser 112. The merged refrigerant flows into the first evaporator 118 through the fifth valve 114 and the first pressure reduction device 116. As described above, in the example of Embodiment 1, while the first compressor 110 of the first refrigeration cycle apparatus 10 is under the low operating frequency control, the first heat source side unit 14 of the first refrigeration cycle apparatus 10 and the second heat source side unit 24 of the second refrigeration cycle apparatus 20 supply refrigerant to the first load side unit 12 of the first refrigeration cycle apparatus 10, and thus, shortage of the amount of refrigerant flowing in the first evaporator 118 can be suppressed. Thus, in Embodiment 1, comfort in a room when the refrigeration cycle system 1 is used for air-conditioning, for example, can be maintained.

At step S10 in FIG. 3, it is determined whether the condensing temperature t1 of the first refrigeration cycle apparatus 10 is abnormally high. While the condensing temperature is abnormally high, the first compressor 110 is under the low operating frequency control, and the operation of the refrigeration cycle system 1 continues with the first valve 312 and the second valve 322 being open.

At step S10, when the condensing temperature t1 of the first refrigeration cycle apparatus 10 returns to a normal temperature range from the abnormally high temperature, the process proceeds to step S12, and the first compressor 110 is controlled under a normal operation frequency control in normal operation. At step S14, the first valve 312 and the second valve 322 are closed, and the first refrigeration cycle apparatus 10 and the second refrigeration cycle apparatus 20 each operate independently. Then, the process returns to step S04.

Then, another example of the condensing temperature restricting operation mode of the refrigeration cycle system 1 will be described with reference to FIGS. 5 and 6. Steps S04 to S08, step S10, and steps S12 to S14 in FIG. 5 are similar to steps S04 to S08, step S10, and steps S12 to S14 in FIG. 3, and thus, description thereof is omitted or simplified in the following description.

At step S02A in FIG. 5, the first refrigeration cycle apparatus 10 illustrated in FIG. 1 is in normal operation. At step S02A, an operation of the second refrigeration cycle apparatus 20 is stopped. While the first refrigeration cycle apparatus 10 is in normal operation and the operation of the second refrigeration cycle apparatus 20 is stopped, the first valve 312 and the second valve 322 are closed, the third valve 120 and the fifth valve 114 are open, and the first refrigeration cycle apparatus 10 operates independently.

At step S04 in FIG. 5, if it is determined that the condensing temperature t1 of the first refrigeration cycle apparatus 10 is abnormally high, step S06 and step S08 are performed. Then, at step S09, a backup operation of the second refrigeration cycle apparatus 20 starts. As indicated in FIG. 6, the backup operation of the second refrigeration cycle apparatus 20 is performed by operating the second compressor 210 with the fourth valve 220 being open and the sixth valve 214 being closed. When the backup operation of the second refrigeration cycle apparatus 20 starts, since the first valve 312 and the second valve 322 are made open at step S08, all the refrigerant flowed out of the second heat source side unit 24 of the second refrigeration cycle apparatus 20 is merged with refrigerant flowed out of the first heat source side unit 14 of the first refrigeration cycle apparatus 10, and flows into the first load side unit 12 of the first refrigeration cycle apparatus 10. This is because the sixth valve 214 is closed in the backup operation of the second refrigeration cycle apparatus 20, and thus, refrigerant flowed out of the second heat source side unit 24 does not flows into the second load side unit 22. Since the first heat source side unit 14 of the first refrigeration cycle apparatus 10 and the second heat source side unit 24 of the second refrigeration cycle apparatus 20 supply refrigerant to the first load side unit 12 of the first refrigeration cycle apparatus 10 while the first compressor 110 of the first refrigeration cycle apparatus 10 is under low operating frequency control, shortage of the amount of refrigerant flowing in the first evaporator 118 can be suppressed.

At step S10, when the condensing temperature t1 of the first refrigeration cycle apparatus 10 returns to a normal temperature range from the abnormally high temperature, the process proceeds to step S11, and the backup operation of the second refrigeration cycle apparatus 20 is stopped. As the stopping of the backup operation of the second refrigeration cycle apparatus 20, an operation of at least the second compressor 210 may be stopped. Then, at step S12, the first compressor 110 is controlled under a normal operation frequency control in normal operation. At step S14, the first valve 312 and the second valve 322 are closed, and the first refrigeration cycle apparatus 10 operates independently. Then, the process returns to step S04.

In the example of the condensing temperature restricting operation mode of the refrigeration cycle system 1 illustrated in FIG. 5, at step S10, the normal operation of the second refrigeration cycle apparatus 20 may be performed after the condensing temperature t1 of the first refrigeration cycle apparatus 10 has returned to the normal temperature range from the abnormally high temperature. That is, the normal operation of the second refrigeration cycle apparatus 20 is performed with the sixth valve 214 being open. Thereafter, at step S12, the first compressor 110 is controlled under a normal operation frequency control, normal operations of the first refrigeration cycle apparatus 10 and the second refrigeration cycle apparatus 20 are performed, and then, the first valve 312 and the second valve 322 are closed at step S14. As described above, the normal operations of the first refrigeration cycle apparatus 10 and the second refrigeration cycle apparatus 20 are performed with the first valve 312 and the second valve 322 being open so that the amount of refrigerant in the first refrigeration cycle apparatus 10 and the amount of refrigerant in the second refrigeration cycle apparatus 20 can be well balanced.

FIG. 7 shows example opening degrees of the first valve and the second valve in the condensing temperature restricting operation mode of the refrigeration cycle system illustrated in FIG. 1. As indicated in FIG. 7, in the condensing temperature restricting operation mode, the first valve 312 and the second valve 322 are made open in such a manner that the opening degrees of the first valve 312 and the second valve 322 are at an intermediate opening degree D1 between a fully closed state D0 and a fully open state DMAX. For example, at time s01, the first valve 312 and the second valve 322 are switched from the fully closed state D0 to the intermediate opening degree D1. At time s02, the first valve 312 and the second valve 322 are switched from the intermediate opening degree D1 to the fully closed state D0. The first refrigeration cycle apparatus 10 and the second refrigeration cycle apparatus 20 are connected to each other with the opening degrees of the first valve 312 and the second valve 322 being set at the intermediate opening degree D1 so that the amounts of refrigerant in the first refrigeration cycle apparatus 10 and the second refrigeration cycle apparatus 20 can be adjusted.

Abnormally High-pressure Operation Mode

In the refrigeration cycle system 1 according to Embodiment, when a high pressure of the first refrigeration cycle apparatus 10 or the second refrigeration cycle apparatus 20 becomes abnormally high, an abnormally high pressure operation mode described below is performed so that the first refrigeration cycle apparatus 10 or the second refrigeration cycle apparatus 20 is protected. This is because when the high pressure of the first refrigeration cycle apparatus 10 or the second refrigeration cycle apparatus 20 becomes abnormally high, the compressor might malfunction or pipes in which high-temperature refrigerant flows might be deformed or damaged, for example. The high pressure of the first refrigeration cycle apparatus 10 or the second refrigeration cycle apparatus 20 becomes abnormally high when the outdoor-air temperature is high, for example. For example, if a high pressure p1 that is a pressure at a discharge side of the first compressor 110 of the first refrigeration cycle apparatus 10 is higher than a determination pressure P1, the high temperature is determined to be abnormally high. For example, if a high pressure p2 that is a pressure at a discharge side of the second compressor 210 of the second refrigeration cycle apparatus 20 is higher than a determination pressure P2, the high temperature is determined to be abnormally high. The determination pressure P1 and the determination pressure P2 are defined based on, for example, specifications of the first refrigeration cycle apparatus 10 and the second refrigeration cycle apparatus 20, and can be the same or different from each other. The following description is directed only to an operation when the high pressure p1 of the first refrigeration cycle apparatus 10 becomes abnormally high. An operation when the high pressure p2 of the second refrigeration cycle apparatus 20 becomes abnormally high is similar to an operation when the high pressure p1 of the first refrigeration cycle apparatus 10 becomes abnormally high, and thus, description thereof will be omitted.

Figure 8:
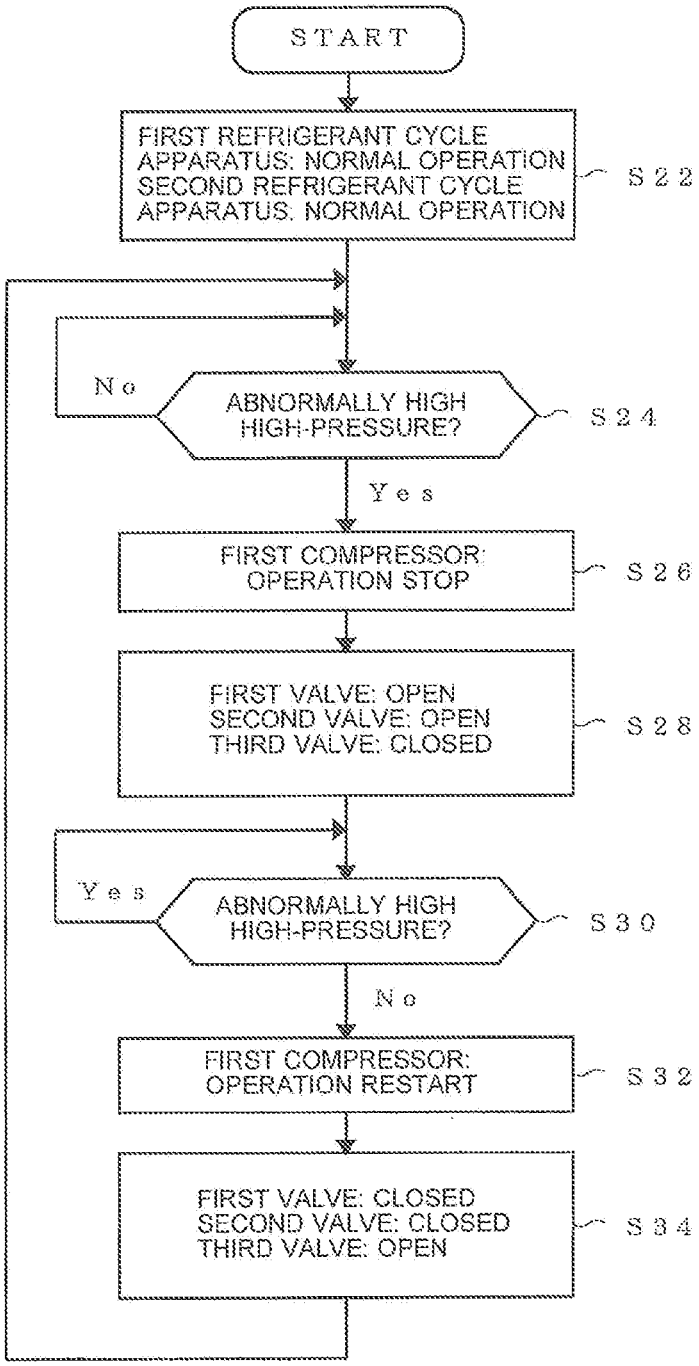
FIG. 8 shows an example operation of the refrigeration cycle system illustrated in FIG. 1 in the abnormally high pressure operation mode.
Figure 10:
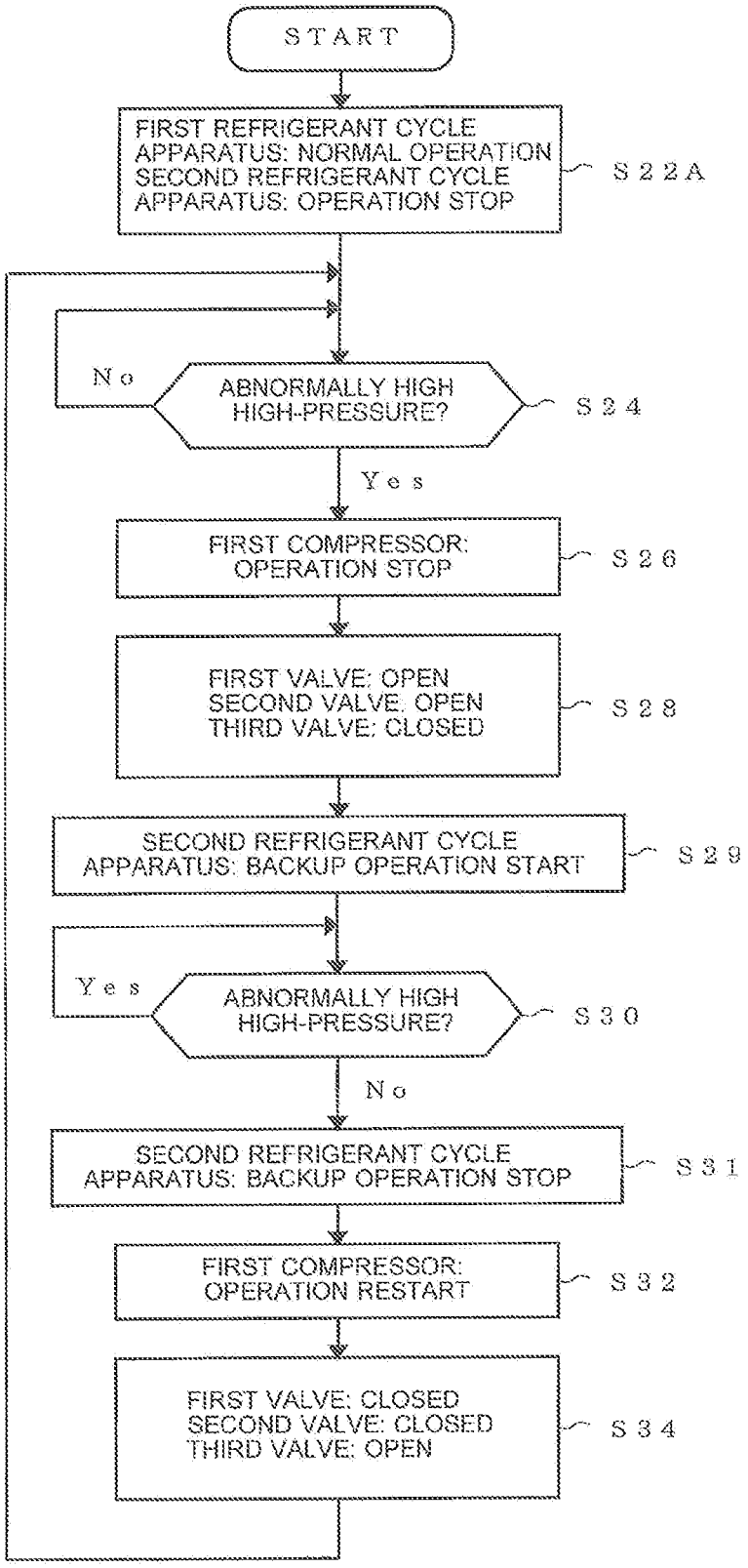
FIG. 10 shows another example operation of the refrigeration cycle system illustrated in FIG. 1 in the abnormally high pressure operation mode.
Figures 11, 12:
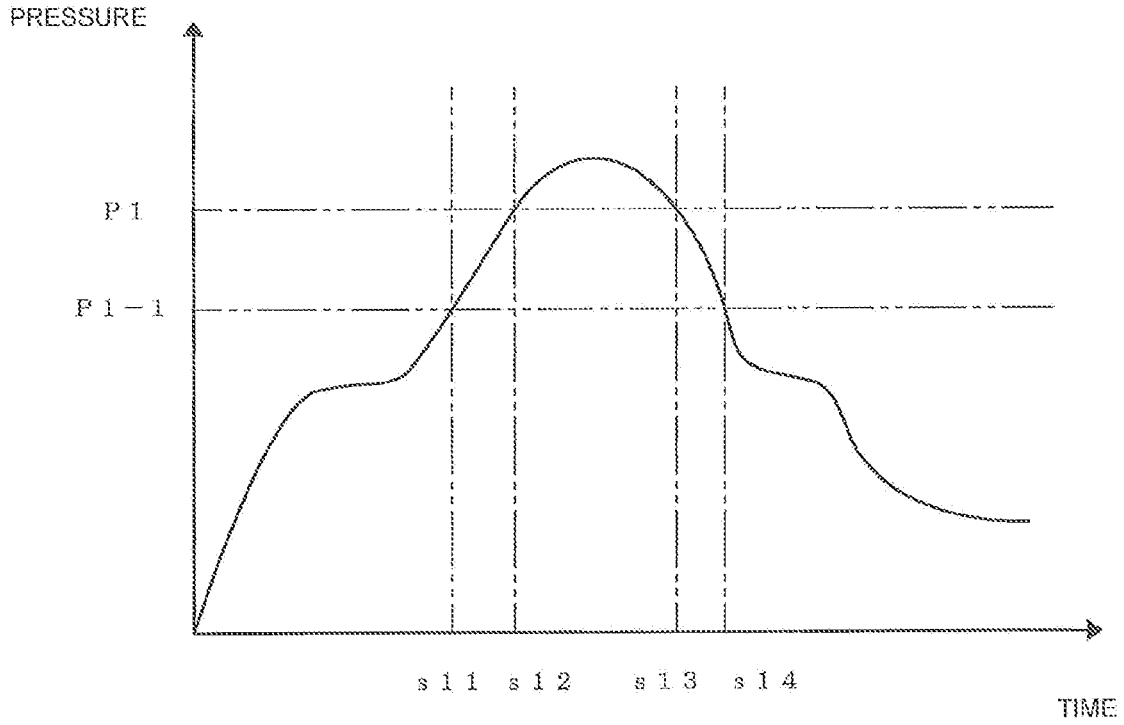
FIG. 11 shows open/close states of valves when the high pressure is abnormally high as shown in FIG. 10.
FIG. 12 shows a variation of timings of opening/closing valves and timings of stopping and restarting operations of compressors, in the abnormally high pressure operation mode of the refrigeration cycle system illustrated in FIG. 1.

FIG. 8 shows an example operation of the refrigeration cycle system illustrated in FIG. 1 in the abnormally high pressure operation mode. FIG. 9 shows open/close states of the valves when the high-pressure is abnormally high as shown in FIG. 8. FIG. 10 shows another example operation of the refrigeration cycle system illustrated in FIG. 1 in the abnormally high pressure operation mode. FIG. 11 shows open/close states of the valves when the high pressure is abnormally high as shown in FIG. 10. The example of the abnormally high pressure operation mode of the refrigeration cycle system 1 described with reference to FIGS. 8 and 9 is an example in which the high pressure p1 of the first refrigeration cycle apparatus 10 becomes abnormally high while the first refrigeration cycle apparatus 10 and the second refrigeration cycle apparatus 20 are in normal operation. The example operation of the abnormally high pressure operation mode of the refrigeration cycle system 1 illustrated in FIGS. 10 and 11 is an example in which the high pressure p1 of the first refrigeration cycle apparatus 10 becomes abnormally high while the first refrigeration cycle apparatus 10 is in normal operation and the second refrigeration cycle apparatus 20 is stopped.

First, an example of the abnormally high pressure operation mode of the refrigeration cycle system 1 will be described with reference to FIGS. 8 and 9. At step S22 in FIG. 8, the first refrigeration cycle apparatus 10 and the second refrigeration cycle apparatus 20 illustrated in FIG. 1 are in normal operation. At step S22, while the first refrigeration cycle apparatus 10 and the second refrigeration cycle apparatus 20 are in normal operation, the first valve 312 and the second valve 322 are closed, the third valve 120, the fourth valve 220, the fifth valve 114, and the sixth valve 214 are open, and the first refrigeration cycle apparatus 10 and the second refrigeration cycle apparatus 20 each operate independently.

At step S24 in FIG. 8, it is determined whether the high pressure p1 of the first refrigeration cycle apparatus 10 is abnormally high. If it is determined that the high pressure p1 is not abnormally high, the normal operations of the first refrigeration cycle apparatus 10 and the second refrigeration cycle apparatus 20 continue.

At step S24, if it is determined that the high pressure p1 of the first refrigeration cycle apparatus 10 is abnormally high, the process proceeds to step S26, where the operation of the first compressor 110 is stopped. By stopping the operation of the first compressor 110, the high pressure p1 of the first refrigeration cycle apparatus 10 can be reduced.

At step S28, as shown in FIG. 9, the first valve 312 and the second valve 322 are made open, and the third valve 120 is closed. As illustrated in FIG. 1, when the first valve 312 and the second valve 322 are open, part of refrigerant flowed out of the second heat source side unit 24 of the second refrigeration cycle apparatus 20 is supplied to the first load side unit 12 of the first refrigeration cycle apparatus 10. That is, part of refrigerant compressed in the second compressor 210 and condensed in the second condenser 212 passes through the second bypass passage 320, and flows into the first evaporator 118 through the fifth valve 114 and the first pressure reduction device 116. As described above, in the example of Embodiment 1, while the first compressor 110 of the first refrigeration cycle apparatus 10 is stopped, the second heat source side unit 24 of the second refrigeration cycle apparatus 20 supplies refrigerant to the first load side unit 12 of the first refrigeration cycle apparatus 10, and thus, refrigerant can flow into the first evaporator 118. In addition, since the third valve 120 is closed while the first compressor 110 of the first refrigeration cycle apparatus 10 is stopped, shortage of the amount of refrigerant flowing in the first evaporator 118 and the second evaporator 218 can be suppressed. Thus, in Embodiment 1, comfort in a room when the refrigeration cycle system 1 is used for air-conditioning, for example, can be maintained.

At step S30, it is determined whether the high pressure p1 of the first refrigeration cycle apparatus 10 is abnormally high. While the high pressure p1 is abnormally high, the operation of the refrigeration cycle system 1 continues with the operation of the first compressor 110 stopped, the first valve 312 and the second valve 322 being open, and the third valve 120 being closed.

At step S30, when the high pressure p1 of the first refrigeration cycle apparatus 10 returns to a normal pressure range from the abnormally high pressure, the process proceeds to step S32, and the operation of the first compressor 110 starts again. Then, at step S34, the first valve 312 and the second valve 322 are closed, the third valve 120 is made open, and the first refrigeration cycle apparatus 10 and the second refrigeration cycle apparatus 20 each operate independently. Thereafter, the process proceeds to step S24.

Another example of the abnormally high pressure operation mode of the refrigeration cycle system 1 will now be described with reference to FIGS. 10 and 11. Steps S24 to S28, step S30, and steps S32 to step S34 in FIG. 10 are similar to steps S24 to S28, step S30, and steps S32 to S34 in FIG. 8, and thus, description thereof is omitted or simplified in the following description.

At step S22A in FIG. 10, the first refrigeration cycle apparatus 10 illustrated in FIG. 1 is in normal operation. At step S22A, an operation of the second refrigeration cycle apparatus 20 is stopped. While the first refrigeration cycle apparatus 10 is in normal operation and the operation of the second refrigeration cycle apparatus 20 is stopped, the first valve 312 and the second valve 322 are closed, the third valve 120 and the fifth valve 114 are open, and the first refrigeration cycle apparatus 10 operates independently.

At step S24 in FIG. 10, if it is determined that the high pressure p1 of the first refrigeration cycle apparatus 10 is abnormally high, steps S26 and S28 are performed. Then, at step S29, a backup operation of the second refrigeration cycle apparatus 20 starts. As shown in FIG. 11, the backup operation of the second refrigeration cycle apparatus 20 is performed by operating the second compressor 210 with the fourth valve 220 being open and the sixth valve 214 being closed. When the backup operation of the second refrigeration cycle apparatus 20 starts, since the first valve 312 and the second valve 322 are open, all the refrigerant flowed out of the second heat source side unit 24 of the second refrigeration cycle apparatus 20 flows into the first load side unit 12 of the first refrigeration cycle apparatus 10. This is because since the sixth valve 214 is closed in the backup operation of the second refrigeration cycle apparatus 20, refrigerant flowed out of the second heat source side unit 24 does not flow into the second load side unit 22. Since the second heat source side unit 24 of the second refrigeration cycle apparatus 20 supplies refrigerant to the first load side unit 12 of the first refrigeration cycle apparatus 10 while the operation of the first compressor 110 of the first refrigeration cycle apparatus 10 is stopped, refrigerant can flow into the first evaporator 118.

At step S30, when the high pressure p1 of the first refrigeration cycle apparatus 10 returns to a normal pressure range from the abnormally high pressure, the process proceeds to step S31, and the backup operation of the second refrigeration cycle apparatus 20 is stopped. As the stopping of the backup operation of the second refrigeration cycle apparatus 20, an operation of at least the second compressor 210 may be stopped. Then, at step S32, the operation of the first compressor 110 starts again, and at step S34, the first valve 312 and the second valve 322 is closed and the first refrigeration cycle apparatus 10 operates independently.

Step S31 and step S32 described above may be replaced with each other so that the backup operation can be stopped after the operation of the first compressor 110 has started again. By stopping the backup operation after starting the operation of the first compressor 110 again, refrigerant can continue to flow into the first evaporator 118.

In the example of the abnormally high pressure operation mode of the refrigeration cycle system 1 shown in FIG. 10, at step S30, after the high pressure p1 of the first refrigeration cycle apparatus 10 has returned to a normal pressure range from the abnormally high pressure, the normal operation of the second refrigeration cycle apparatus 20 may be performed. That is, the normal operation of the second refrigeration cycle apparatus 20 is performed with the sixth valve 214 being open. The normal operations of the first refrigeration cycle apparatus 10 and the second refrigeration cycle apparatus 20 are performed with the first valve 312 and the second valve 322 being open so that the amount of refrigerant in the first refrigeration cycle apparatus 10 and the amount of refrigerant in the second refrigeration cycle apparatus 20 can be well balanced.

Variation 1

FIG. 12 shows a variation of timings of opening/closing the valves and timings of stopping and restarting operations of the compressors, in the abnormally high pressure operation mode of the refrigeration cycle system illustrated in FIG. 1. As shown in FIG. 12, in Variation 1, an operation of the first compressor 110 is stopped and restarted using the determination pressure P1, and opening/closing of the first valve 312, the second valve 322, and the third valve 120 is set using a determination pressure P1−1. The determination pressure P1−1 is a value concerning a pressure lower than the determination pressure P1, and when the high pressure p1 increases to a pressure higher than the determination pressure P1−1, the high pressure p1 is expected to be then higher than the determination pressure P1. When the high pressure p1 becomes higher than the determination pressure P1−1 at time s11 in FIG. 12, the first valve 312 and the second valve 322 are made open and the third valve 120 is closed. At time s12, when the high pressure p1 becomes higher than the determination pressure P1, the operation of the first compressor 110 is stopped. At time s13, when the high pressure p1 becomes lower than the determination pressure P1, the operation of the first compressor 110 is restarted. At time s14, when the high pressure p1 decreases to the determination pressure P1−1 or less, the first valve 312 and the second valve 322 are closed and the third valve 120 is made open. In Variation 1, before the operation of the first compressor 110 is stopped, the first valve 312 and the second valve 322 are made open and the third valve 120 is closed. Thus, before the operation of the first compressor 110 is stopped, refrigerant in the first heat source side unit 14 is moved to the second heat source side unit 24. Thus, in Variation 1, the possibility of shortage of refrigerant can be reduced in the abnormally high pressure operation mode of the refrigeration cycle system 1.

Figure 13:
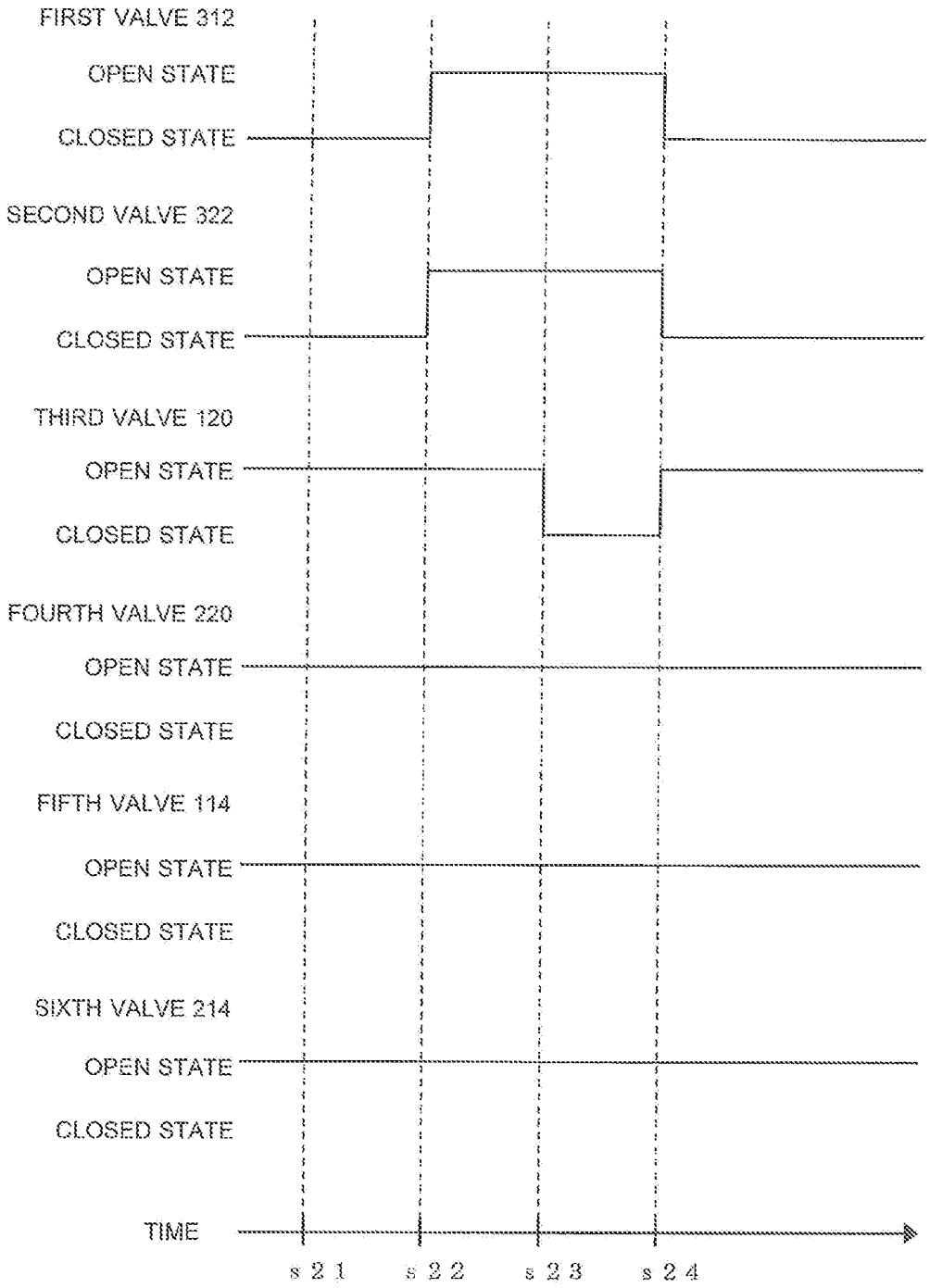
FIG. 13 shows an example operation of the refrigeration cycle system illustrated in FIG. 1.

FIG. 13 shows an example operation of the refrigeration cycle system illustrated in FIG. 1. From time s21 to time s22 in FIG. 13, the refrigeration cycle system 1 operates in the normal operation mode. Specifically, at time s21 to time s22, the first valve 312 and the second valve 322 illustrated in FIG. 1 are closed, the third valve 120, the fourth valve 220, the fifth valve 114, and the sixth valve 214 are open, and the first refrigeration cycle apparatus 10 and the second refrigeration cycle apparatus 20 each operate independently. From time s22 to time s23, the refrigeration cycle system 1 operates in the condensing temperature restricting operation mode. That is, at time s22, since it is determined that the condensing temperature t1 of the first refrigeration cycle apparatus 10 is abnormally high, the condensing temperature restricting operation mode is performed with the first valve 312, the second valve 322, the third valve 120, the fourth valve 220, the fifth valve 114, and the sixth valve 214 being open. From time s23 to time s24, the refrigeration cycle system 1 operates in the abnormally high pressure operation mode. That is, at time s23, since it is determined that the high pressure p1 of the first refrigeration cycle apparatus 10 is abnormally high, the abnormally high pressure operation mode is performed with the first valve 312, the second valve 322, the fourth valve 220, the fifth valve 114, and the sixth valve 214 being open and the third valve 120 being closed. Then, at time s24, the condensing temperatures of the first refrigeration cycle apparatus 10 and the second refrigeration cycle apparatus 20 fall into the normal temperature range, and the high pressures of the first refrigeration cycle apparatus 10 and the second refrigeration cycle apparatus 20 fall in the normal pressure range. Thus, the refrigeration cycle system 1 operates in the normal operation mode.

As described above, the refrigeration cycle system 1 according to Embodiment 1 includes: the first refrigeration cycle apparatus 10 which is connected to the first compressor 110, the first condenser 112, the first pressure reduction device 116, and the first evaporator 118 and through which the refrigerant circulates; the second refrigeration cycle apparatus 20 which is connected to the second compressor 210, the second condenser 212, the second pressure reduction device 216, and the second evaporator 218 and through which the refrigerant circulates; the first bypass passage 310 connecting a portion between the first evaporator 118 and the first compressor 110 to a portion between the second evaporator 218 and the second compressor 210; and the second bypass passage 320 connecting a portion between the first condenser 112 and the first pressure reduction device 116 to a portion between the second condenser 212 and the second pressure reduction device 216. Thus, in the refrigeration cycle system 1 according to Embodiment 1, the first refrigeration cycle apparatus 10 and the second refrigeration cycle apparatus 20 can be obtained by connection using the first bypass passage 310 and the second bypass passage 320. For example, in a case where one of the compressors becomes abnormal or malfunctions, the other compressor can supply refrigerant to the first load side unit 12 of the first refrigeration cycle apparatus 10 and the second load side unit 22 of the second refrigeration cycle apparatus 20 by connecting the first refrigeration cycle apparatus 10 and the second refrigeration cycle apparatus 20 to each other using the first bypass passage 310 and the second bypass passage 320.

In the example of Embodiment 1, the first valve 312 is disposed on the first bypass passage 310, and the second valve 322 is disposed on the second bypass passage 320. For example, the first refrigeration cycle apparatus 10 and the second refrigeration cycle apparatus 20 can each operate independently by closing the first valve 312 and the second valve 322 while the first refrigeration cycle apparatus 10 and the second refrigeration cycle apparatus 20 are in normal state. For example, in a case where the condensing temperature becomes abnormally high, the operating frequency of one of the first compressor 110 and the second compressor 210 to which detected abnormally high condensing temperature corresponds is reduced and the first valve 312 and the second valve 322 are made open. Thus, the refrigeration cycle system 1 can be protected while suppressing a decrease in the amount of refrigerant flowing in the evaporator in the refrigeration cycle apparatus whose abnormally high condensing temperature was detected.

In the example of Embodiment 1, the third valve 120 is disposed between the first evaporator 118 and the first compressor 110, the fourth valve 220 is disposed between the second evaporator 218 and the second compressor 210, and the first bypass passage 310 connects a portion between the first evaporator 118 and the third valve 120 to a portion between the second evaporator 218 and the fourth valve 220. For example, when the pressure becomes abnormally high, the operation of one of the first compressor 110 and the second compressor 210 whose abnormally high pressure was detected is stopped, and the first valve 312 and the second valve 322 are made open, one of the third valve 120 and the fourth valve 220 disposed at a suction side of the compressor whose abnormally high pressure was detected is closed. Thus, the refrigeration cycle system 1 can be protected while suppressing a decrease in the amount of refrigerant flowing in the evaporator.

In the example of Embodiment 1, the fifth valve 114 is disposed between the first condenser 112 and the first pressure reduction device 116, the sixth valve 214 is disposed between the second condenser 212 and the second pressure reduction device 216, and the second bypass passage 320 connects a portion between the first condenser 112 and the fifth valve 114 to a portion between the second condenser 212 and the sixth valve 214. For example, opening/closing of the fifth valve 114 and the sixth valve 214 is controlled, for example, so that refrigerant can be supplied to the evaporator of a load side unit to be used while a flow of refrigerant into the evaporator of an unused load side unit is prevented.

The present invention is not limited to Embodiment described above, and variously modified within the scope of the invention. That is, the configuration of Embodiment may be arbitrarily changed, or at least part of the configuration may be replaced by another configuration. Arrangement of components that are not specifically described is not limited to that described in Embodiment, and may be any arrangement as long as the functions thereof can be achieved.

For example, in the following description, each of the first pressure detection device 126 and the second pressure detection device 226 detects a high pressure and determines whether the high pressure is abnormally high by comparing the detected high pressure with a determination pressure as a determination value. Alternatively, the first pressure detection device 126 and the second pressure detection device 226 may be, for example, switches each indicating that the high pressure becomes higher than the determination pressure.

In the example described above, the heat source side unit includes the condenser, and the load side unit includes an evaporator. Alternatively, the heat source side unit may include an evaporator and the load side unit may include a condenser.

REFERENCE SIGNS LIST

1 refrigeration cycle system, 10 first refrigeration cycle apparatus, 11 first refrigerant circuit, 12 first load side unit, 14 first heat source side unit, 20 second refrigeration cycle apparatus, 21 second refrigerant circuit, 22 second load side unit, 24 second heat source side unit, 110 first compressor, 112 first condenser, 114 fifth valve, 116 first pressure reduction device, 118 first evaporator, 120 third valve, 124 first accumulator, 126 first pressure detection device, 128 first pipe temperature detection device, 130 first condensing temperature detection device, 210 second compressor, 212 second condenser, 214 sixth valve, 216 second pressure reduction device, 218 second evaporator, 220 fourth valve, 224 second accumulator, 226 second pressure detection device, 228 second pipe temperature detection device, 230 second condensing temperature detection device, 310 first bypass passage, 312 first valve, 320 second bypass passage, 322 second valve, 500 controller

The invention claimed is:

1. A refrigeration cycle system comprising:

a first refrigeration circuit that is connected to a first compressor, a first condenser, a first pressure reduction device, and a first evaporator, and through which refrigerant circulates;

a second refrigeration circuit that is connected to a second compressor, a second condenser, a second pressure reduction device, and a second evaporator, and through which the refrigerant circulates;

a first bypass passage connecting a first portion of the first refrigeration circuit, which is between the first evaporator and the first compressor, to a first portion of the second refrigeration circuit, which is between the second evaporator and the second compressor; and a second bypass passage connecting a second portion of the first refrigeration circuit, which is between the first condenser and the first pressure reduction device, to a second portion of the second refrigeration circuit, which is between the second condenser and the second pressure reduction device, wherein the first refrigeration circuit includes a third valve disposed between the first evaporator and the first compressor and configured to control a passage of the refrigerant, the second refrigeration circuit includes a fourth valve disposed between the second evaporator and the second compressor and configured to control a passage of the refrigerant, the first portion of the first refrigeration circuit extends between the first evaporator and the third valve, the first portion of the second refrigeration circuit extends between the second evaporator and the fourth valve, and the first portion of the second refrigeration circuit does not include the second compressor.

2. The refrigeration cycle system of claim 1, further comprising:

a first valve disposed on the first bypass passage and configured to control a passage of the refrigerant; and a second valve disposed on the second bypass passage and configured to control a passage of the refrigerant.

3. The refrigeration cycle system of claim 2, wherein the first valve and the second valve are closed while the first refrigeration circuit and the second refrigeration circuit are in normal states.

4. The refrigeration cycle system of claim 2, wherein the first refrigeration circuit further includes a first condensing temperature sensor configured to detect a condensing temperature of the first refrigeration cycle apparatus, the second refrigeration circuit further includes a second condensing temperature sensor configured to detect a condensing temperature of the second refrigeration circuit, and when the first condensing temperature sensor or the second condensing temperature sensor detects an abnormally high condensing temperature, an operating frequency of one of the first compressor and the second compressor to which the detected abnormally high condensing temperature corresponds is reduced, and the first valve and the second valve are made open.

5. The refrigeration cycle system of claim 2, wherein the first refrigeration circuit further includes a first pressure sensor configured to detect a pressure of the refrigerant discharged from the first compressor, the second refrigeration circuit further includes a second pressure sensor configured to detect a pressure of the refrigerant discharged from the second compressor, and when the first pressure sensor or the second pressure sensor detects an abnormally high pressure, an operation of one of the first compressor and the second compressor having the detected abnormally high pressure is stopped, the first valve and the second valve are made open, and one of the third valve and the fourth valve disposed at a suction side of the compressor having the detected abnormally high pressure is closed.

6. The refrigeration cycle system of claim 1, wherein the first refrigeration circuit further includes a fifth valve disposed between the first condenser and the first pressure reduction device and configured to control a passage of the refrigerant, the second refrigeration circuit further includes a sixth valve disposed between the second condenser and the second pressure reduction device and configured to control a passage of the refrigerant, and the second bypass passage connects a portion between the first condenser and the fifth valve to a portion between the second condenser and the sixth valve.

* * * * *